US008636502B2

(12) United States Patent
Anderson

(10) Patent No.: US 8,636,502 B2
(45) Date of Patent: Jan. 28, 2014

(54) SELECTIVE LOCKOUT IN A FUEL-FIRED APPLIANCE

(75) Inventor: Peter Anderson, St. Paul, MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 13/457,401

(22) Filed: Apr. 26, 2012

(65) Prior Publication Data

US 2012/0208132 A1 Aug. 16, 2012

Related U.S. Application Data

(63) Continuation of application No. 12/757,502, filed on Apr. 9, 2010, now Pat. No. 8,177,544.

(51) Int. Cl.
*F23N 5/00* (2006.01)

(52) U.S. Cl.
USPC ..... 431/78; 431/77; 431/70; 431/6

(58) Field of Classification Search
USPC ..... 431/78, 77, 70, 6, 13, 14, 15; 700/275
See application file for complete search history.

(56) References Cited

U.S. PATENT DOCUMENTS

| | | | |
|---|---|---|---|
| 3,574,496 | A | 4/1971 | Hewitt |
| 3,887,325 | A | 6/1975 | Finger et al. |
| 4,033,711 | A | 7/1977 | Christian et al. |
| 4,906,177 | A | 3/1990 | Newberry et al. |
| 5,090,895 | A | 2/1992 | Jensen et al. |
| 5,174,743 | A | 12/1992 | Wellman et al. |
| 5,180,301 | A | 1/1993 | Gross |
| 5,236,328 | A | 8/1993 | Tate et al. |
| 5,261,609 | A | 11/1993 | Roth |
| 5,346,391 | A | 9/1994 | Fullemann et al. |
| 5,368,230 | A | 11/1994 | Oppenberg |
| 5,515,297 | A | 5/1996 | Bunting |
| 5,567,143 | A | 10/1996 | Servidio |
| 5,636,981 | A | 6/1997 | Lilly |
| 5,795,462 | A | 8/1998 | Shurtleff |
| 5,899,684 | A | 5/1999 | McCoy et al. |
| 5,921,470 | A | 7/1999 | Kamath |
| 6,004,127 | A | 12/1999 | Heimberg et al. |
| 6,092,738 | A | 7/2000 | Becker |
| 6,099,295 | A | 8/2000 | McCoy et al. |
| 6,119,954 | A | 9/2000 | Kamath |

(Continued)

OTHER PUBLICATIONS

Beckett Residential Burners, "AF/AFG Oil Burner Manual", 24 pages, Aug. 2009.

(Continued)

*Primary Examiner* — Alfred Basichas
(74) *Attorney, Agent, or Firm* — Seager Tufte & Wickhem, LLC.

(57) ABSTRACT

A control system for a fuel-fired appliance and methods of operating are disclosed. When a failed ignition of a burner is detected, the control system is configured to enter a soft lockout state if the voltage level of a burner of the fuel-fired appliance is low during the failed ignition and a hard lockout state if the voltage level of the burner is not low during the failed ignition. In some cases, if a period of time has elapsed and/or the voltage level of the burner has increased after the control system enters the soft lockout state, the control system may be configured to initiate one or more subsequent ignition trials. In some cases, if the one or more subsequent ignition trials fail, the control system may be configured to then enter the hard lockout state.

20 Claims, 9 Drawing Sheets

(56) References Cited

U.S. PATENT DOCUMENTS

| | | | |
|---|---|---|---|
| 6,135,366 | A | 10/2000 | Bodelin et al. |
| 6,260,773 | B1 | 7/2001 | Kamath |
| 6,464,000 | B1 | 10/2002 | Kloster |
| 6,561,792 | B1 | 5/2003 | Pfund |
| 6,700,495 | B2 | 3/2004 | Mindermann et al. |
| 6,829,123 | B2 | 12/2004 | Legatti et al. |
| 6,953,161 | B2 | 10/2005 | Laursen et al. |
| 8,177,544 | B2 | 5/2012 | Anderson |
| 2006/0084019 | A1 | 4/2006 | Berg et al. |
| 2007/0143000 | A1 | 6/2007 | Bryant et al. |
| 2009/0017406 | A1 | 1/2009 | Farias Fuentes et al. |
| 2011/0247604 | A1 | 10/2011 | Anderson |
| 2011/0250546 | A1 | 10/2011 | Anderson |

OTHER PUBLICATIONS

Honeywell, "S9230F1006 2-Stage Hot Surface Ignition Integrated Furnace Controls, Installation Instructions", 20 pages, 2006.

Tradeline, "Oil Controls, Service Handbook", 84 pages, prior to Apr. 9, 2010.

Underwriters Laboratories Inc. (UL), "UL 296, Oil Burners", ISBN 1-55989-627-2, 107 pages, Jun. 30, 1994.

SELECTIVE LOCKOUT IN A FUEL-FIRED APPLIANCE

This application is a continuation of U.S. patent application Ser. No. 12/757,502, filed Apr. 9, 2010 and entitled "SELECTIVE LOCKOUT IN A FUEL-FIRED APPLIANCE", which is incorporated herein by reference.

FIELD

The present disclosure relates generally to fuel-fired controllers, and more particularly, to systems and methods for selectively locking out operation of a fuel-fired appliance after one or more failed ignition trials.

BACKGROUND

Numerous fuel fired appliances have an igniter for igniting the fuel upon command. Fuel fired appliances include, for example, heating, ventilation, and air conditioning (HVAC) appliances such as furnaces, boilers, water heaters, as well as other HVAC appliances and non-HVAC appliances. Fuel fired appliances typically have a combustion chamber and a burner. A fuel source, such as a gas or oil, is typically provided to the burner through a valve or the like. In many cases, various electrical and/or electromechanical components are provided to help control and/or otherwise carry out the intended function of the fuel fired appliance. For example, various controllers, motors, igniters, blowers, switches, motorized valves, motorized dampers, and/or others, are often included in, or are used to support, a fuel fired appliance.

One particular type of fuel fired appliance is a fuel fired furnace. Fuel fired furnaces are frequently used in homes and office buildings to heat intake air received through return ducts and distribute heated air through warm air supply ducts. Such furnaces typically include a circulation blower or fan that directs cold air from the return ducts across metal surfaces of a heat exchanger to heat the air to an elevated temperature. A burner is often used to heat the metal surfaces of the heat exchanger. The air heated by the heat exchanger can be discharged into the supply ducts via the circulation blower or fan, which produces a positive airflow within the ducts.

In some instances, the burner of the fuel fired appliance may fail to ignite the fuel during an ignition trial. For safety and other reasons, many controllers, such as controllers for oil-fired appliance, are "single trial devices" that lockout operation of the burner after a single failed ignition trial and prevent further operation of the burner until the controller is manually reset by a service technician. Under some circumstances, however, the failed ignition may be the result of a condition that does not necessarily impact the ability of the appliance to safely operate in the future. One example condition may be a temporary drop in the line voltage provided to the burner (e.g. burner motor). Accordingly, there is a need for new and improved systems and methods for selectively controlling the lockout of fuel fired appliances after one or more failed ignition trials.

SUMMARY

The present disclosure relates generally to fuel-fired controllers, and more particularly, to systems and methods for selectively locking out operation of a fuel-fired appliance after one or more failed ignition trials. In one illustrative embodiment, a control system for a fuel-fired appliance is configured to enter a soft lockout state or a hard lockout state during or after a failed ignition attempt, depending on the voltage level provided to the burner from an electrical power supply at the time of the ignition trial. If the voltage level at a burner of the fuel-fired appliance is low during a failed ignition attempt, the control system may enter a soft lockout state. In some cases, when in the soft lockout state, the control system may be configured to initiate one or more subsequent ignition trials if a period of time has elapsed and/or the voltage level of the burner has increased. If the one or more subsequent ignition trials fail, the control system may be configured to enter the hard lockout state.

In another illustrative embodiment, a method for controlling the operation of a burner in a fuel-fired appliance is disclosed. The method may include determining a voltage level of the burner prior to or during a failed ignition trial and, if the voltage level of the burner is less than a low voltage level prior to or during the failed ignition trial, entering a soft lockout state that temporarily prevents ignition of the burner. If the voltage level of the burner is greater than the low voltage level prior to or during the failed ignition trial, entering a hard lockout state that prevents ignition of the burner until the hard lockout state is manually overridden. In some cases, the method may also include, after entering the soft lockout state, attempting one or more subsequent ignition trials when the voltage level of the burner has increased to a voltage level greater than the low voltage level and/or a period of time has elapsed. In some cases, the method may further include entering the hard lockout state if the one or more subsequent ignition trials fail. In some instances, the low voltage level may be adjusted over time based on the voltage present during past successful and/or failed ignition trails.

The preceding summary is provided to facilitate an understanding of some of the innovative features unique to the present disclosure and is not intended to be a full description. A full appreciation of the disclosure can be gained by taking the entire specification, claims, drawings, and abstract as a whole.

BRIEF DESCRIPTION

The invention may be more completely understood in consideration of the following detailed description of various illustrative embodiments of the disclosure in connection with the accompanying drawings, in which.

DETAILED DESCRIPTION

Figure 1:
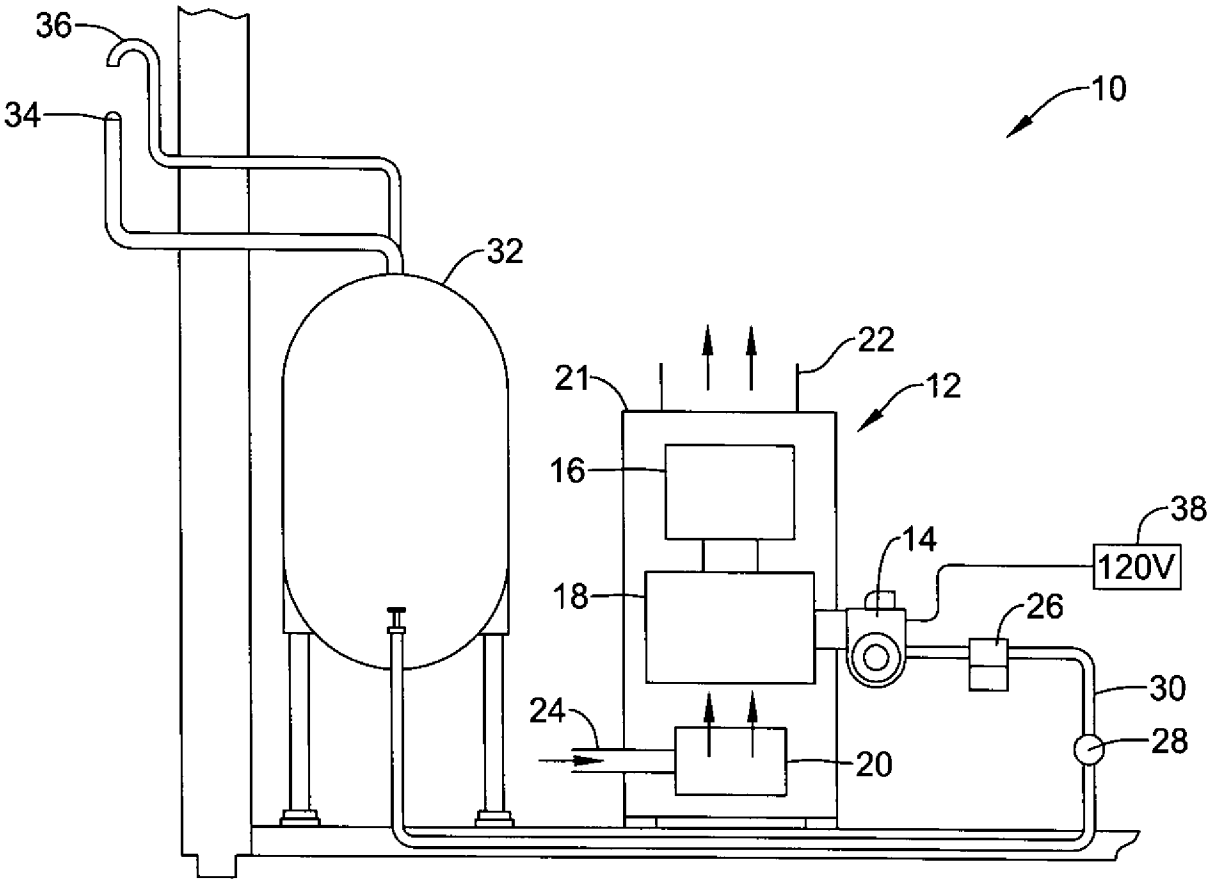
FIG. 1 is a schematic diagram of an illustrative embodiment of an oil-fired HVAC system for a building or other structure.

The following description should be read with reference to the drawings wherein like reference numerals indicate like elements throughout the several views. The detailed description and drawings show several embodiments which are meant to be illustrative of the claimed invention.

For illustrative purposes only, much of the present disclosure has been described with reference to an oil-fired furnace. However, this description is not meant to be so limited, and it is to be understood that the features of the present disclosure may be used in conjunction with any suitable fuel-fired system utilizing a flame detector or flame detection system. For example, it is contemplated that the features of the present disclosure may be incorporated into an oil-fired furnace, an oil-fired water heater, an oil-fired boiler, a gas-fired furnace, a gas-fired boiler, a gas-fired water heater, and/or other suitable fuel-fired system, as desired.

FIG. 1 is a schematic diagram of an illustrative embodiment of an oil-fired HVAC system 10 for a building or other structure. As illustrated, the HVAC system 10 includes a storage tank 32 and an oil fired appliance 12 including a burner 14. Oil can be stored in storage tank 32 and fed to the burner 14 of the fuel fired appliance 12 via a supply line 30. As illustrated, storage tank 32 may include an air vent 36 and a fill line 34 for filling the storage tank 32 with oil, but these are not required. For mere exemplary purposes, the storage tank 32 is illustrated as an above-ground storage tank, but may be implemented as a below ground storage tank or any other suitable oil storage tank, as desired. Alternatively, oil or another fuel may be provided directly to the oil fired appliance 12 via a pipe from a utility or the like, depending on the circumstances.

A valve 28 is shown situated in the supply line 30. The valve 28 can provide and/or regulate the flow of oil from the storage tank 32 (or utility) to the burner 14. In some embodiments, valve 28 may regulate the oil pressure supplied to the burner 14 at specific limits established by the manufacturer and/or by an industry standard. Such a valve 28 can be used, for example, to establish an upper limit to prevent over-combustion within the appliance 12, or to establish a lower limit to prevent combustion when the supply of oil is insufficient to permit proper operation of the appliance 12.

In some cases, a filter 26 may be situated in the supply line 30. The filter 26 may be configured to filter out contaminants and/or other particulate matter from the oil before the oil reaches the burner assembly 14 of the oil-fired appliance 12.

In the illustrative embodiment, the oil-fired appliance, illustratively an oil-fired furnace 12, includes a circulation fan or blower 20, a combustion chamber/primary heat exchanger 18, a secondary heat exchanger 16, and an exhaust system (not shown), each of which can be housed within furnace housing 21. In some cases, the circulation fan 20 can be configured to receive cold air via a cold air return duct 24 (and/or an outside vent) of a building or structure, circulate the cold air upwards through the furnace housing 21 and across the combustion chamber/primary heat exchanger 18 and the secondary heat exchangers 16 to heat the air, and then distribute the heated air through the building or structure via one or more supply air ducts 22. In some cases, circulation fan 20 can include a multi-speed or variable speed fan or blower capable of adjusting the air flow between either a number of discrete airflow positions or variably within a range of airflow positions, as desired. In other cases, the circulation fan 20 may be a single speed blower having an "on" state and an "off" state.

Burner assembly 14 can be configured to heat one or more walls of the combustion chamber/primary heat exchanger 18 and one or more walls of the secondary heat exchanger 16 to heat the cold air circulated through the furnace 12. At times when heating is called for, the burner assembly 14 is configured to ignite the oil supplied to the burner assembly 14 via supply line 30 and valve 28, producing a heated combustion product. The heated combustion product of the burner assembly 14 may pass through the combustion chamber/primary heat exchanger 18 and secondary heat exchanger 16 and then be exhausted to the exterior of the building or structure through an exhaust system (not shown). In some embodiment, an inducer and/or exhaust fan (not shown) may be provided to help establish the flow of the heated combustion product to the exterior of the building.

In the illustrative embodiment, an electrical power source, such as a line voltage supply 38 (e.g. 120 volts, 60 Hz AC), may provide electrical power to at least some of the components of the oil-fired HVAC system 10, such as the oil-fired furnace 12 and/or more specifically the burner assembly 14. The line voltage supply 38 in the United States typically has three lines, L1, neutral, and earth ground, and is often used to power higher power electrical and/or electromechanical components of the oil-fired HVAC system 10, such as circulation fan or blower 20, an ignition systems of the burner assembly 14, and/or other higher power components. In some cases, a step down transformer can be provided to step down the incoming line voltage supply 38 to a lower voltage supply that is useful in powering lower voltage electrical and/or electromechanical components if present, such as controllers, motorized valves or dampers, thermostats, and/or other lower voltage components. In one illustrative embodiment, the transformer may have a primary winding connected to terminals L1 and neutral of the line voltage supply 38, and a secondary winding connected to the power input terminals of controller to provide a lower voltage source, such as 24 volt 60 Hz AC voltage, but this is not required.

Although not specifically shown in FIG. 1, it is contemplated that the oil-fired HVAC systems may include other typical HVAC components including, for example, thermostats, sensors, switches, motorized valves, non-motorized valves, motorized dampers, non-motorized dampers, and/or others HVAC components, as desired.

Figure 2:
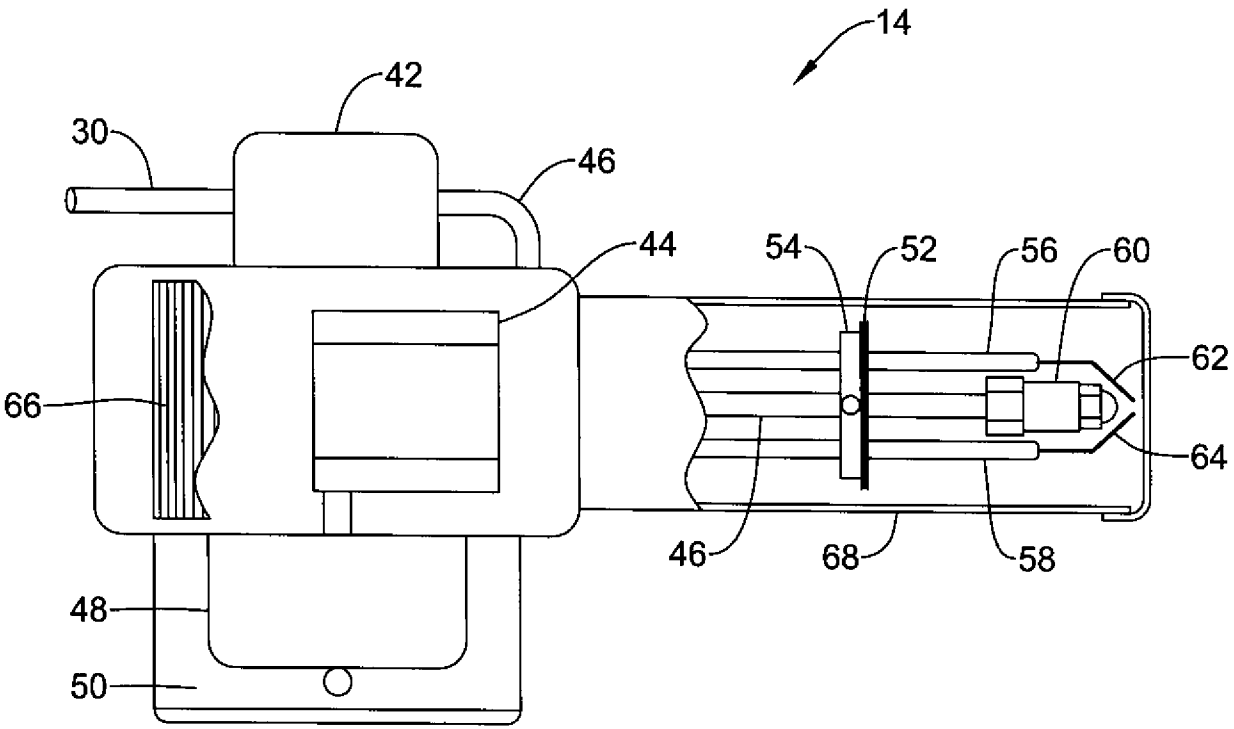
FIG. 2 is a partial cut-away top view of an illustrative oil-fired burner assembly of the HVAC system of FIG. 1.
Figure 3:
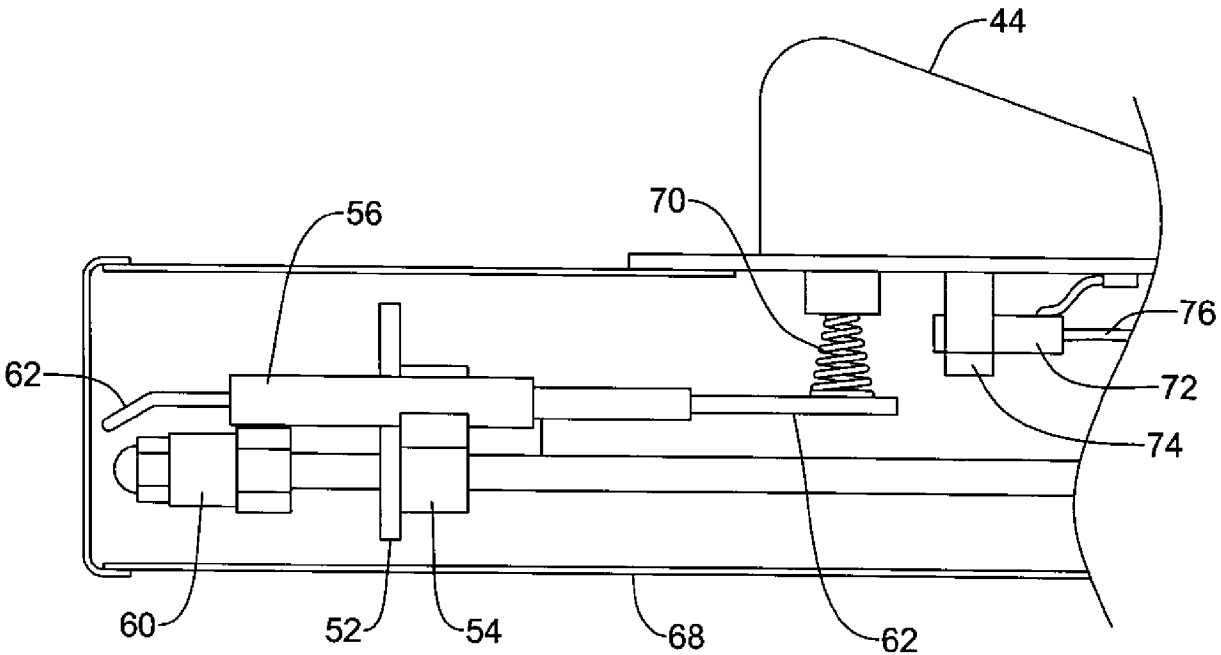
FIG. 3 is a partial cross-sectional view of the illustrative oil-fired burner assembly of FIG. 2.

FIG. 2 is partial cut-away top view and FIG. 3 is a partial cross-sectional view of an illustrative burner assembly 14 of the oil-fired HVAC system 10 of FIG. 1. In the illustrative embodiment, the burner assembly 14 is configured to atomize the oil (i.e. break the oil into small droplets) and mix the atomized oil with air to form a combustible mixture. The combustible mixture is sprayed into the combustion chamber/primary heat exchanger 18 of the oil-fired furnace 12 (shown in FIG. 1) and ignited with a spark (or pilot flame) from an ignition system of the burner assembly 14.

In the illustrative embodiment, the burner assembly 14 may include a pump 42, a nozzle 60, a motor 50, a blower 66, an air tube 68, an ignition transformer 44, and the ignition system. The pump 42 may have an inlet connected to the oil supply line 30 and an outlet connected to the nozzle 60 via a nozzle line 46. The pump 42 may deliver oil under pressure to the nozzle 60. At the nozzle 60, the oil may be broken into droplets forming a mist that is sprayed into combustion chamber/primary heat exchanger 18. In some situations, the nozzle 60 may break the oil into a relatively fine, cone-shaped mist cloud.

At the same time as the oil mist is being sprayed into the combustion chamber/primary heat exchanger 18, the blower 66, which is driven by motor 50, may be configured to provide an airstream, which in some cases, may be a relatively turbulent airstream, through air tube 68 to mix with the oil mist sprayed into the combustion chamber/primary heat exchanger 18 by the nozzle 60 to form a good combustible mixture. In some cases, a static pressure disc 52 or other restrictor can be positioned in the air tube 68 to create the relatively turbulent airstream or air swirls to mix the airstream and oil mist.

In the illustrative embodiment, the ignition system of the burner assembly 14 may include one or more electrodes, such as electrodes 62 and 64, having one end electrically connected to the ignition transformer 44 and another end extending adjacent to the nozzle 60 and into the oil mist provided by the nozzle 60. When an electrical current is provided to electrodes 62 and/or 64 from the ignition transformer 44, the electrical current may create a "spark" that can ignite the combustible mixture and produce a flame. In some embodiments, the electrodes 62 and 64 may be secured and/or mounted relative to the nozzle 60 in the flow tube 68 with a mounting bracket 54. To electrically insulate the electrodes 62 and 64 from the mounting bracket 54, an insulated material or covering, shown as 56 and 58, may be provided over a portion of the electrodes 62 and 64. As shown in FIG. 3, one end of the electrodes 62 and 64 can be electrically connected to the ignition transformer 44 via one or more springs 70. However, it is contemplated that other suitable connectors may be used to electrically connect electrodes 62 and 64 to ignition transformer 44, as desired.

In the illustrative embodiment, a controller 48 may be included or electrically connected to the burner assembly 14. The controller 48, which may be an oil primary control, may be electrically connected to and/or control the operation of motor 50 for driving blower 66, ignition transformer 44, pump 42, and/or oil valve 28 in response to signals received from one or more thermostats or other controllers (not shown). Although not shown, the controller 48 may be linked to the one or more thermostats and/or other controllers via a communications bus (wired or wireless) upon which heat demand calls may be communicated to the furnace 12. The controller 48 may also be used to control various components of the furnace 12 including the speed and/or operation of the circulation fan 20, as well as any airflow dampers (not shown), sensors (not shown), or other suitable component, as desired.

In the illustrative embodiment, the controller 48 may be configured to control the burner assembly 14 between a burner ON cycle and a burner OFF cycle according to one or more heat demand calls received from the thermostat. When a burner ON cycle is called for, the controller 48 may initiate an ignition trial of the burner assembly 14 by providing oil to the burner assembly by actuating valve 28, activating the pump 42 to provide pressurized fuel to nozzle 60, and activating motor 50 to drive blower 66 to provide air for mixing with the oil mist to form a good combustible mixture. The controller 48 may also be configured to selectively energize electrodes 62 and 64 using ignition transformer 44 to ignite the combustible mixture. The energized electrodes 62 and 64 may create a "spark" to ignite the combustible mixture and produce a flame. When a burner OFF cycle is called for, the controller 48 may be configured to actuate valve 28 to cease providing oil provided to the burner assembly 14 and shut off motor 50 and pump 42.

As shown in FIG. 3, a flame detector 72 can be provided in or adjacent to the burner assembly 14 in some embodiments. The flame detector 72 may be configured to detect the presence of a flame during an ignition trial and the burner ON cycle. In some cases, the flame detector 72 may include a light sensitive detector, such as a light sensitive cadmium sulfide (CAD) cell 72. In the example shown, the light sensitive CAD cell 72 may be mounted or otherwise secured in the air tube 68 with holder 74 so that it can view the flame. The CAD cell 72 may be electrically connected to the controller 48 via wires 76 and may send a signal to the controller 48 indicating the presence or absence of a flame. As the resistance of the cad cell 72 is light dependent, the resistance of the CAD cell 72 may decrease with more light (e.g. flame present) and may increase with less light (e.g. no flame). In some embodiments, the CAD cell 72 may "watch" the burner assembly 14 for a flame on startup and throughout the burner ON cycle. If the flame fails for any reason, the CAD cell 72 may send a signal to the controller 48 indicating that no flame is present and the controller may shut down the burner assembly 14.

Figure 4:
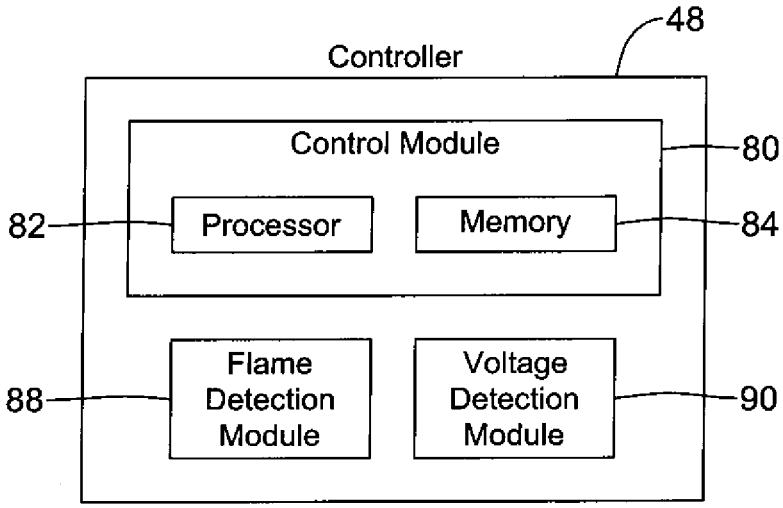
FIG. 4 is a block diagram of an illustrative controller that may be used in conjunction with the oil-fired HVAC system of FIGS. 1-3.

FIG. 4 is a block diagram of an illustrative controller 10 that may be used in conjunction with the oil-fired HVAC system of FIGS. 1-3. In the illustrative embodiment, the controller 48 includes a control module 80, a flame detection module 88, and a voltage detection module 90. Control module 80 may be configured to control the activation of one or more components of the oil-fired HVAC system 10, such as the burner assembly 14, valve 28, and/or oil-fired furnace 12, in response to signals received from one or more thermostats (not shown) or other controllers. For example, control module 80 may be configured to control the burner assembly 14 between a burner ON cycle and a burner OFF cycle according to the one or more heat demand calls. In some instances, control module 80 may include a processor 82 and a memory 84.

Memory 84 may be configured to store any desired information, such as programming code for implementing the algorithms set forth herein, one or more settings, parameters, schedules, trend logs, setpoints, and/or other information, as desired. Control module 80 may be configured to store information within memory 84 and may subsequently retrieve the stored information. Memory 84 may include any suitable type of memory, such as, for example, random-access memory (RAM), read-only member (ROM), electrically erasable programmable read-only memory (EEPROM), Flash memory, and/or any other suitable memory, as desired.

Flame detection module 88 may be configured to detect whether a flame is present or absence during an ignition trial and burner ON cycle. In some cases, the flame detection module 88 may include suitable circuitry or devices to detect the presence of a flame in the combustion chamber 18. In some cases, the flame detection module 88 may be coupled to or in electrical communication with a light sensitive detector, such as CAD cell 72 shown in FIG. 3. As discussed above, the resistance of CAD cell 72 may be light sensitive, and may vary according to the presence or absence of a flame. If the flame fails or is not detected, the flame detection module 88 may send a signal to the control module 80 indicating that no flame is present and the control module 80 may shut down the burner assembly 14 and/or valve 28.

Voltage detection module 90 may be configured to measure a voltage level of the burner assembly 14 during, for example, the ignition trial, the burner ON cycle and/or the burner OFF cycle. In some cases, voltage detection module 90 may include suitable circuitry to measure the voltage level corresponding to the voltage level of the electrical power source 38 (shown in FIG. 1) and/or burner assembly 14. If, for example, the voltage level of the electrical power source 38 drops, the burner assembly 14 may have a decreased voltage level available and the motor 50 may not spin fast enough to properly atomize the oil for ignition, causing the ignition trial to fail. The voltage detection module 90 may send a signal to the control module 80 corresponding to the level of voltage detected in the burner assembly 14 and/or voltage level provided by the electrical power source 38.

In the illustrative embodiment, the control module 80 of controller 48 may be configured to enter one or more lockout states, such as a hard lockout state or a soft lockout state, upon the detection of a failed ignition trial (e.g. no flame detected by flame detection module 88 during an ignition trial). In some instances, a hard lockout state may prevent subsequent operation of the burner assembly 14 until a service technician services the burner assembly 14 and/or oil-fired furnace 12 and manually overrides the hard lockout. A soft lockout state may temporarily prevent operation of the burner assembly 14 but may recover, in some cases automatically, without requiring a service technician to override the soft lockout.

In the illustrative embodiment, the control module 80 may be configured to enter a soft lockout state when the voltage detection module 90 detects a "low" voltage level during a failed ignition trial, and enter a hard lockout state when the voltage detection module 90 detects a "normal" voltage level range during a failed ignition trial. In some cases, the voltage level may be considered "low" if it is less than a low voltage level (e.g. threshold) stored in the memory 84 of the control module 80, but this is not required. In other cases, the voltage level may be considered "low" if it is less than a voltage level of one or more prior successful ignition trials.

In some cases, the low voltage level may be predefined by a user or technician or determined by tracking the voltage levels of successful and failed ignition attempts. For example, if the burner assembly 14 fails to ignite at 80 volts, but ignites at 90 volts, the low voltage level may be set as a value between 80 volts and 90 volts, such as 85 volts, for example. If during a subsequent attempt the burner assembly 14 fails to ignite at 85 volts, but ignites at 90 volts, the low voltage level may be set as a value between 85 volts and 90 volts, such as 87.5 volts, for example. This may be repeated over time to iteratively arrive at a "low" voltage level, which may track the performance of the burner assembly 14 over time. In some cases, even if the low voltage level is predefined by a service technician or manufacturer, the low voltage level may be adjusted in a similar manner. This is, however, not required or even desired in some cases.

In some cases, the low voltage level may be 110 volts AC, 105 volts AC, 100 volts AC, 95 volts AC, 90 volts AC, 85 volts AC, 80 volts AC, or any other suitable voltage level, as desired. A voltage level may be considered a "normal" voltage level when the voltage is greater than the low voltage level, at a level where successful ignition has previously occurred, or near the voltage level of the electrical power supply 38 (e.g. 110 volts AC, 115 volts AC, 120 volts AC, etc.), or at any other suitable voltage level where successful ignition is expected. In some embodiments, the "low" voltage levels and "normal" voltage levels may be stored in memory 84, but this is not required.

In some embodiments, the control module 80 may be configured to recover from the soft lockout state after a period of time has elapsed and/or the voltage level of the burner assembly 14 has increased. In some cases, the period of time may be 1 minute, 2 minutes, 5 minutes, 10 minutes, 15 minutes, 30 minutes, 1 hour, or any other suitable period of time, as desired. In some cases, the voltage level of the burner assembly 14 may need to rise to the "normal" voltage level (e.g. greater than the low voltage level, at a level where successful ignition has previously occurred, and/or near 110 volts AC, 115 volts AC, 120 volts AC) before the control module 80 has recovered from the soft lockout state. When the control module 80 has "recovered" from the soft lockout state, the control module 80 may initiate one or more subsequent ignition trials. In some cases, if the flame detection block 88 continues to detect the absence of a flame during the one or more subsequent ignition trials, the control module 80 may be configured to enter a hard lockout state.

In some embodiments, the control module 80 may also have a low voltage detect (LVD) level, which may be stored in memory 84, where ignition of the burner assembly 14 is not attempted if the voltage level is detected to be below the LVD level, which is less than the low voltage level discussed above. In some embodiments, the LVD level may be predefined or preprogrammed into the memory 84. For example, the LVD level may be 80 volts, 81 volts, 82 volts, 83 volts, 84 volts, 85 volts, 90 volts, 95 volts, 100 volts, or any other suitable voltage level where ignition of the burner assembly 14 may fail. However, in some cases, the LVD level may vary according to the specific operating conditions and components of a particular burner assembly 14. For example, a first burner assembly may operate properly at 80 volts and a different second burner assembly may fail to ignite at 95 volts. Also, the "low" voltage level for a given burner assembly 14 may change over time. As detailed above, and in some embodiments, the controller 48 may be configured to monitor and/or track the voltage level of successful and/or unsuccessful ignition trials and adjust the LVD level accordingly. This, however, is not required.

Although not shown in FIG. 4, it is contemplated that the controller 48 may include a user interface that is configured to display and/or solicit information as well as permit a user to enter data and/or other settings, as desired. In some instances, the user interface may include a touch screen, a liquid crystal display (LCD) panel and keypad, a dot matrix display, a computer, buttons and/or any other suitable interface, as desired.

It should be recognized that the foregoing oil-fired HVAC system 10 is merely illustrative and it is to be understood that the following methods may be incorporated into any suitable controller or control system for any suitable oil-fired system.

Figure 5:
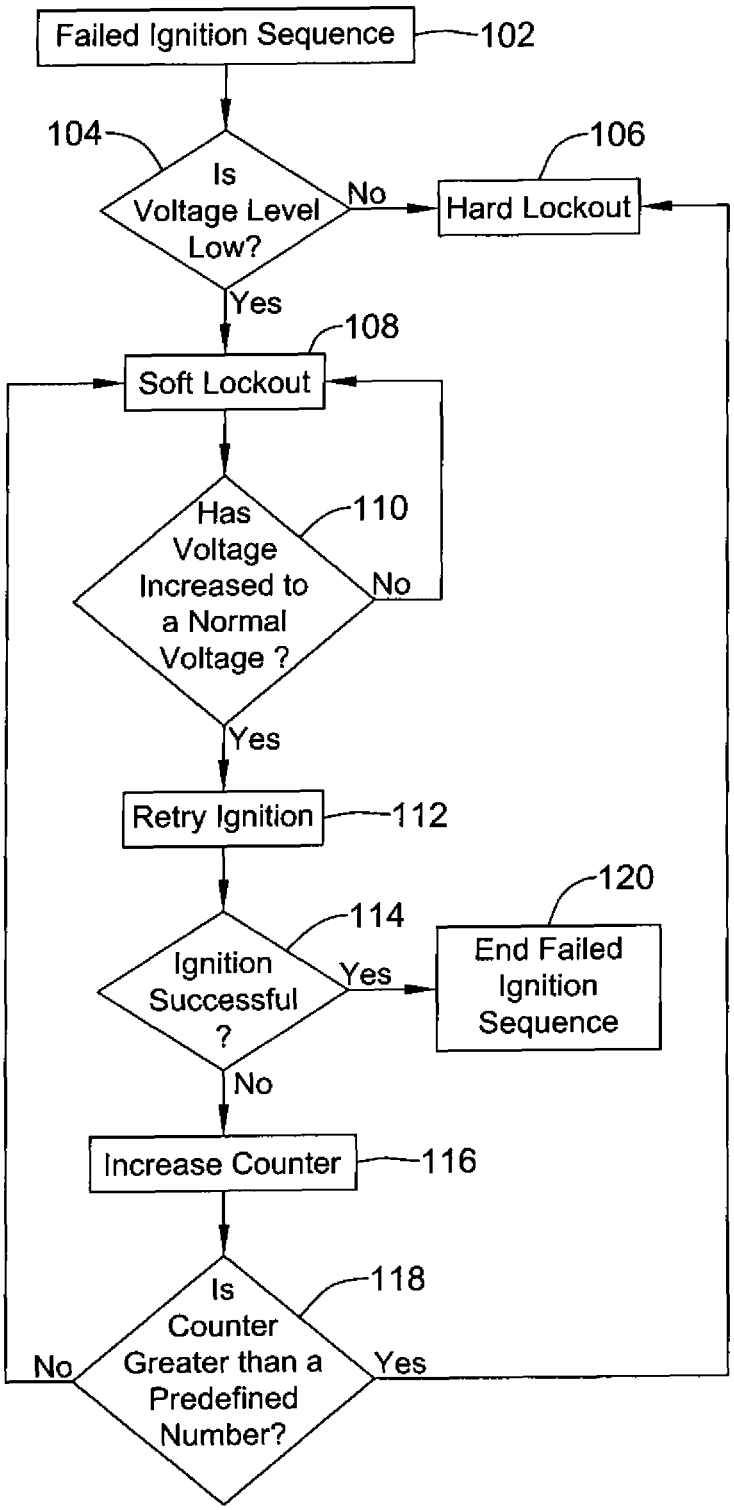
FIGS. 5-9 are flow diagrams showing illustrative methods for selectively locking out control of the oil-fired burner in FIGS. 1-3.

FIG. 5 is an illustrative flow diagram of a method of operating the controller after a failed ignition sequence. As shown in block 102, the failed ignition sequence may begin after a failed ignition attempt is detected by the flame detector or CAD cell 72. In decision block 104, the controller may determine if the voltage level of the burner assembly is low. If the voltage level was not determined to be low, then in block 106, the controller enters a hard lockout state preventing further ignition attempts of the burner assembly. If the voltage was determined as being low, then in block 108, the controller enters a soft lockout state.

In some embodiments, after the controller entered the soft lockout state, as shown in decision block 110, the controller may then determine if the voltage level of the burner assembly has returned to a "normal" voltage level range, such as a voltage level greater than 100 volts AC, than 110 volts AC, or any other voltage level. If the voltage level has increased to a "normal" voltage level range, the controller may retry ignition of the burner assembly in block 112. If the voltage level has not increased to a "normal" voltage level range, then the controller may return to block 108.

If the controller retried ignition in block 112, then in decision block 114, the controller may determine if the ignition trial was successful. If the ignition trial was successful, then in block 120, the controller may end the failed ignition sequence and return to normal operation. If the retried ignition trial was not successful, the controller may either move to the soft lockout state or in the hard lockout state depending on the number of failed ignition trials. If, for example, only two failed ignition trials are desired, the controller would at this time enter the hard lockout state in block 106. As shown in FIG. 5, the controller may continue to operate in the soft lockout state for a three or more failed ignition attempts before entering the hard lockout state. However, it is contemplated that the controller may be programmed to have two, three, four, five, six, seven, eight, nine, ten, or any other number of consecutive failed ignition attempts before entering the hard lockout state.

In the illustrative example shown in FIG. 5, the controller 48 can track the number of consecutive failed ignition attempts using a counter, however, other systems or methods for tracking the number of consecutive failed ignition attempts may be used. In the illustrative example, after the controller determined the ignition attempt failed in decision block 114, in block 116, the controller may increase a value of a counter. In the illustrative embodiment, counter may be reset to one after each successful ignition is detected. Then, in block 118, the controller may determine if the counter value is greater than a predefined number of failed ignition attempts, which may be two, three, four, five, six, seven, eight, nine, ten, or any other number of consecutive failed ignition attempts. If the counter is greater than the predefined number of failed ignition attempts, the controller enters the hard lockout state of block 106. If the counter is not greater than a predefined number of failed ignition sequences, then the controller moves to block 108 and continue to operate in the soft lockout state. Blocks 110, 112, 114, 116, and 118 may be repeated until the controller enters the hard lockout state, shown in block 106, or a successful ignition is detected in block 114.

Figure 6:
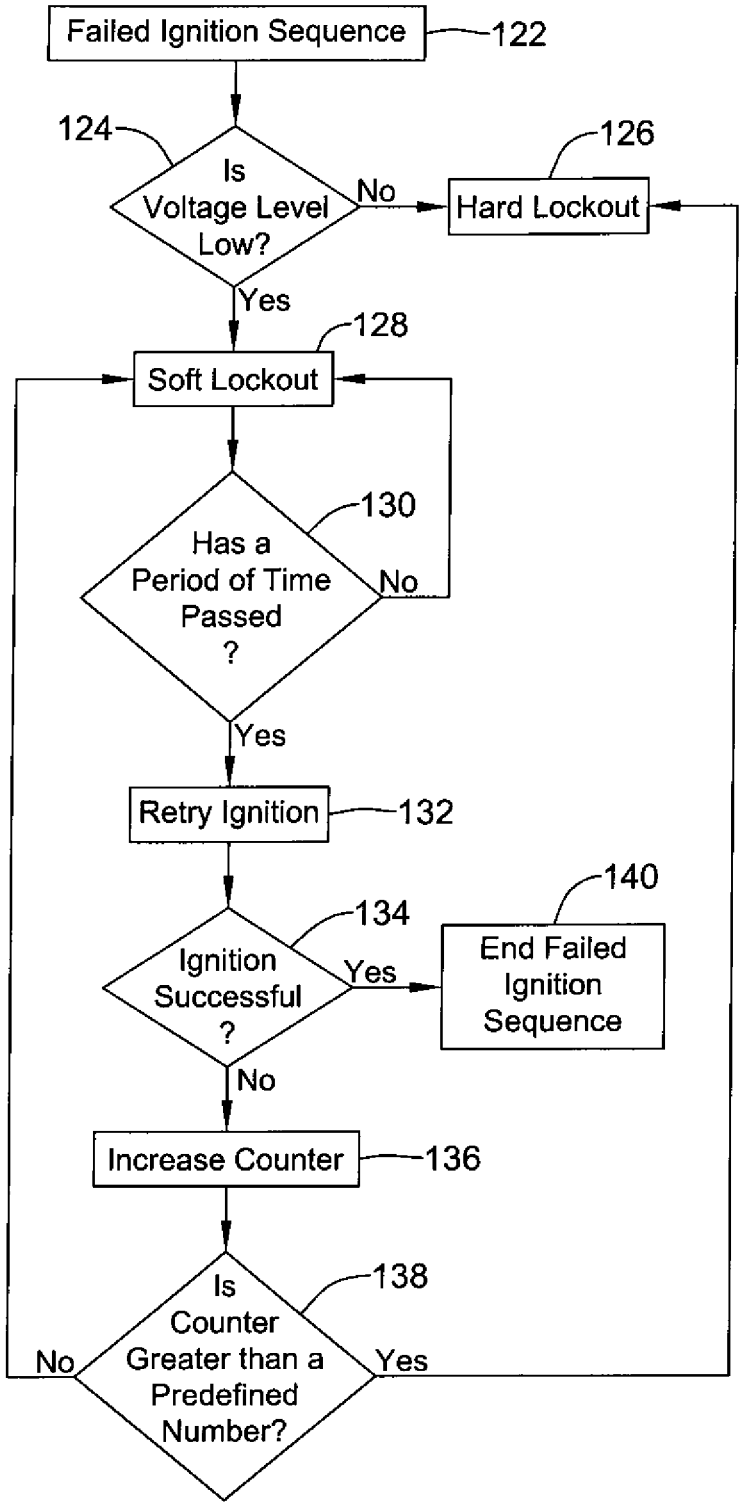

FIG. 6 is an illustrative flow diagram of another method of operating the controller after a failed ignition attempt. As shown in block 122, the failed ignition sequence may begin after a failed ignition sequence is detected by the flame detector or CAD cell 72. In decision block 124, the controller may determine if the voltage level of the burner assembly is low. If the voltage level was not determined to be low, then in block 126, the controller enters a hard lockout state preventing further ignition attempts of the burner assembly. If the voltage was determined as being low, then in block 128, the controller may enter a soft lockout state.

In some embodiments, after the controller entered the soft lockout state, as shown in decision block 130, the controller may then determine if a period of time has passed since the last failed ignition trial. In some cases, the period of time may be 1 minute, 2 minutes, 5 minutes, 10 minutes, 15 minutes, 30 minutes, 1 hour, or any other period of time, as desired. If the period of time has passed, the controller may retry ignition of the burner assembly in block 132. If the period of time has not passed, then the controller may return to the soft lockout state in block 128.

If the controller retried ignition in block 132, then in decision block 134, the controller may determine if the ignition trial was successful. If the ignition trial was successful, then in block 140, the controller may end the failed ignition sequence and return to normal operation. If the retried ignition trial was not successful, the controller may either operate in the soft lockout state or in the hard lockout state depending on the number of failed ignition trials. If, for example, only two failed ignition trials are desired, the controller would at this time enter the hard lockout state in block 126. As shown in FIG. 6, the controller may continue to operate in the soft lockout state for a three or more failed ignition attempts before entering the hard lockout state. However, it is contemplated that the controller may be programmed to have two, three, four, five, six, seven, eight, nine, ten, or any other number of consecutive failed ignition attempts before entering the hard lockout state.

In the illustrative example shown in FIG. 6, the controller 48 can track the number of consecutive failed ignition attempts using a counter, however, other systems or methods for tracking the number of consecutive failed ignition attempts may be used. In the illustrative example, after the controller determined the ignition attempt failed in decision block 134, in block 136, the controller may increase a value of a counter. In the illustrative embodiment, counter may be reset to one after each successful ignition is detected. Then, in block 138, the controller may determine if the counter value is greater than a predefined number of failed ignition attempts, which may be two, three, four, five, six, seven, eight, nine, ten, or any other number of consecutive failed ignition attempts. If the counter is greater than the predefined number of failed ignition attempts, the controller enters the hard lockout state of block 126. If the counter is not greater than a predefined number of failed ignition sequences, then the controller moves to block 108 and continue to operate in the soft lockout state. Blocks 130, 132, 136, and 138 may be repeated until the controller enters the hard lockout state, shown in block 126, or a successful ignition is detected in block 134.

Figure 7:
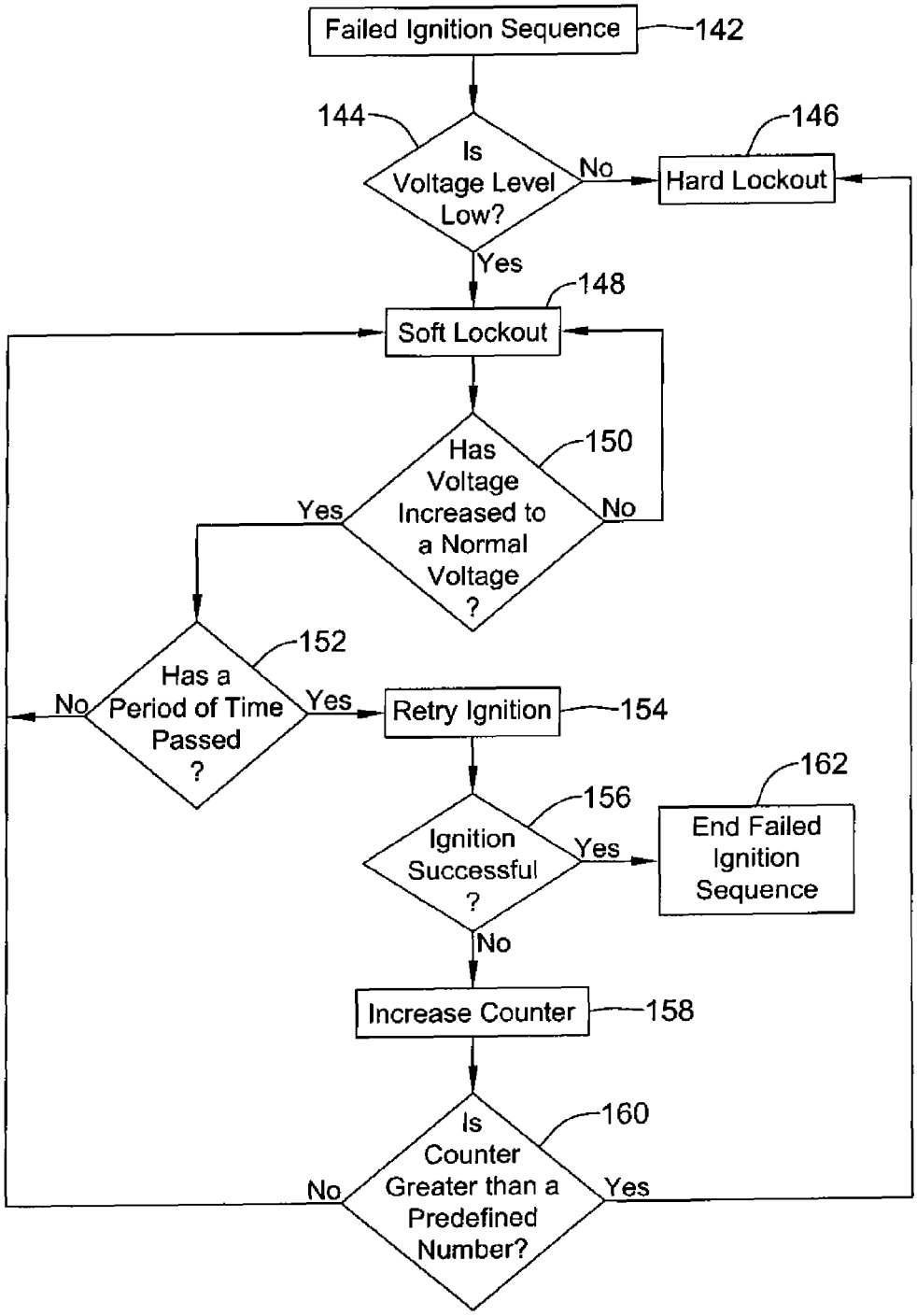

FIG. 7 is an illustrative flow diagram of a method of operating the controller after a failed ignition sequence. As shown in block 142, the failed ignition sequence may begin after a failed ignition attempt is detected by the flame detector or CAD cell 72. In decision block 144, the controller may determine if the voltage level of the burner assembly is low. If the voltage level was not determined to be low, then in block 146, the controller enters a hard lockout state preventing further ignition attempts of the burner assembly. If the voltage was determined as being low, then in block 148, the controller enters a soft lockout state.

In some embodiments, after the controller entered the soft lockout state, as shown in decision block 150, the controller may then determine if the voltage level of the burner assembly has returned to a "normal" voltage level range, such as a voltage level greater than 100 volts AC, than 110 volts AC, or any other voltage level. If the voltage level has not increased to a "normal" voltage level range, then the controller may return to block 148. If the voltage level has increased to a normal voltage level range, then in decision block 152, the controller may then determine if a period of time has passed since the last failed ignition trial. In some cases, the period of time may be 1 minute, 2 minutes, 5 minutes, 10 minutes, 15 minutes, 30 minutes, 1 hour, or any other period of time, as desired. If the period of time has passed, the controller may retry ignition of the burner assembly in block 154. If the period of time has not passed, then the controller may return to the soft lockout state in block 148. Further, it is contemplated that decision blocks 150 and 152 may be reversed in order, if desired.

If the controller retried ignition in block 154, then in decision block 156, the controller may determine if the ignition trial was successful. If the ignition trial was successful, then in block 162, the controller may end the failed ignition sequence and return to normal operation. If the retried ignition trial was not successful, the controller may either operate in the soft lockout state or in the hard lockout state depending on the number of failed ignition trials. If, for example, only two failed ignition trials are desired, the controller would at this time enter the hard lockout state in block 146. As shown in FIG. 7, the controller may continue to operate in the soft lockout state for a three or more failed ignition attempts before entering the hard lockout state. However, it is contemplated that the controller may be programmed to have two, three, four, five, six, seven, eight, nine, ten, or any other number of consecutive failed ignition attempts before entering the hard lockout state.

In the illustrative example shown in FIG. 7, the controller 48 can track the number of consecutive failed ignition attempts using a counter, however, other systems or methods for tracking the number of consecutive failed ignition attempts may be used. In the illustrative example, after the controller determined the ignition attempt failed in decision block 156, in block 158, the controller may increase a value of a counter. In the illustrative embodiment, counter may be reset to one after each successful ignition is detected. Then, in block 160, the controller may determine if the counter value is greater than a predefined number of failed ignition attempts, which may be two, three, four, five, six, seven, eight, nine, ten, or any other number of consecutive failed ignition attempts. If the counter is greater than the predefined number of failed ignition attempts, the controller enters the hard lockout state of block 146. If the counter is not greater than a predefined number of failed ignition sequences, then the controller moves to block 148 and continue to operate in the soft lockout state. Blocks 152, 154, 156, 158, and 160 may be repeated until the controller enters the hard lockout state, shown in block 146, or a successful ignition is detected in block 156.

Figure 8:
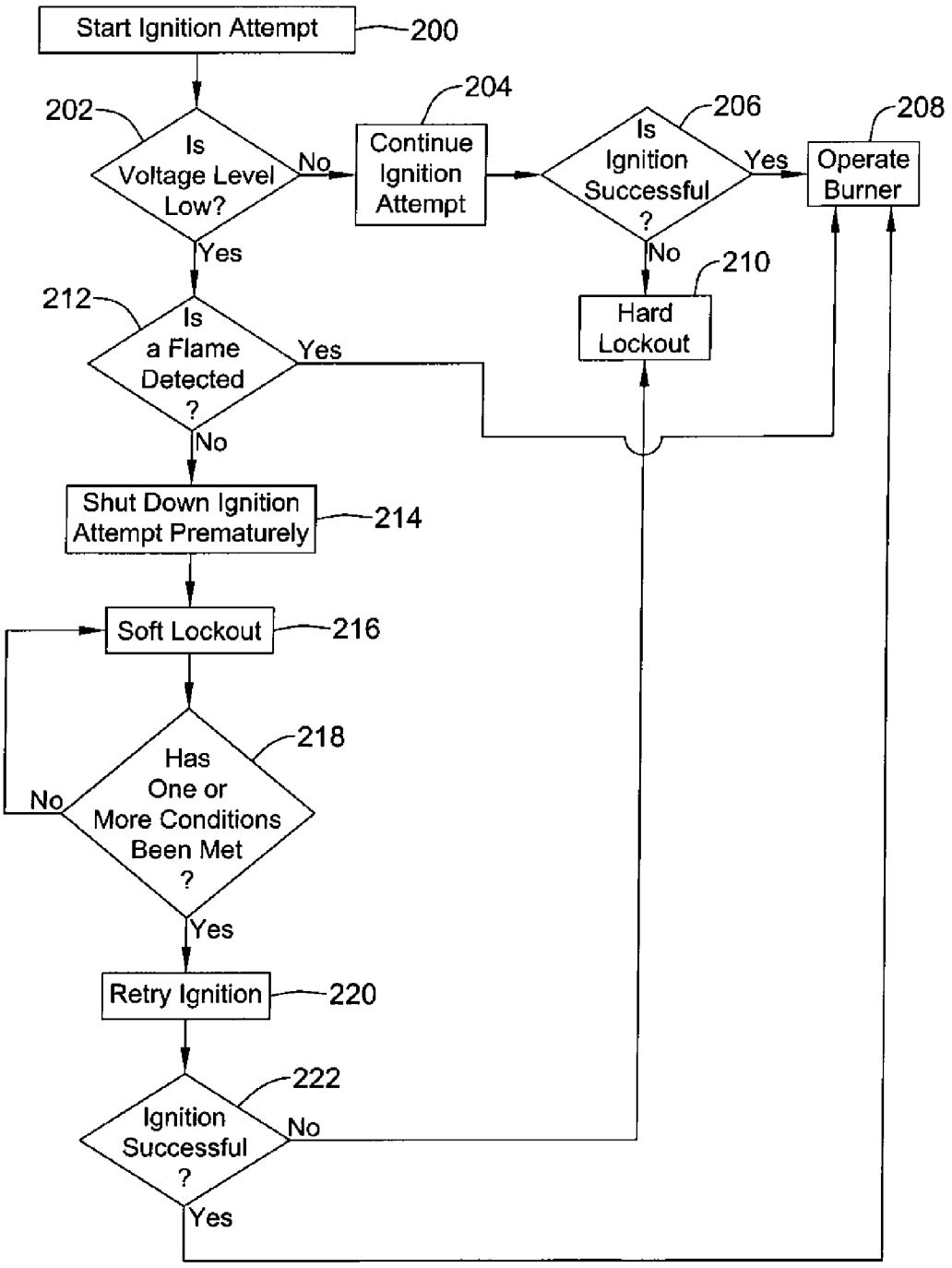

FIG. 8 is a flow diagram of an illustrative method of operating a fuel-fired controller. In some embodiments, the illustrative method may be employed by controller 48 shown in FIG. 4. As shown in block 200, the controller may start an ignition attempt to attempt to ignite the fuel. In decision block 202, the controller may determine if the voltage level of the burner assembly is low. If the voltage level was not determined to be low, then in block 204, the controller may continue the ignition attempt. Further, it is contemplated that the voltage level of the burner may be detected prior to the start of the ignition attempt, if desired. In decision block 206, the controller may determine if the ignition attempt was successful (e.g. flame detected in burner). If the ignition attempt was successful, in block 208, the controller may operate the burner assembly under normal operating condition. If the ignition attempt was not successful, in block 210, the controller enters a hard lockout state.

If the voltage was determined as being low in decision block 202, then in decision block 212, the controller may determine a flame is detected in the burner assembly. If a flame is detected, then in block 208, the controller may operate the burner assembly under normal operating condition. If a flame was not detected in decision block 212, then in block 214, the controller may shut down the ignition attempt prematurely. For example, if the controller is programmed to perform an ignition attempt for 15 seconds, the controller may end the ignition attempt at 10 seconds, 12 seconds, 14.5 seconds, or any period of time prior to the full length of the ignition attempt, which in the example case is 15 seconds. This is just one example duration of time for an ignition attempt and it is contemplated that any suitable duration of time may be used, as desired. The duration of time could also, for example, be based on historical performance of the burner, if desired. Then, in block 216, the controller enters a soft lockout state. Further, it is contemplated that decision blocks 202 and 212 may be reversed in order, if desired.

In decision block 218, the controller may determine if one or more conditions have been met. Example conditions may be similar to those discussed above and may include the voltage level increasing to a "normal" voltage level range, a period of time has passed, or other conditions, as desired. If one or more of the conditions have not been met, the controller may stay in the soft lockout state in block 216. If one or more of the conditions have been met, then in block 220, the controller can retry ignition. Then, in decision block 222, the controller may determine if the ignition trial was successful. If the ignition trial was successful, then in block 208, the controller may operate the burner assembly. If the retried ignition trial was not successful, the controller may enter the hard lockout state in block 210. Although not shown in the flow diagram of FIG. 8, it is contemplated that the controller may return to the soft lockout state 216 and may retry ignition a number of times prior to entering the hard lockout state in block 210. It is contemplated that the controller may be programmed to have two, three, four, five, six, seven, eight, nine, ten, or any other number of consecutive failed ignition attempts before entering the hard lockout state, as desired. In some embodiments, to track the number of ignition attempts, a counter similar to the counter in FIGS. 5-7 may be implemented, if desired.

In addition, although not shown in FIG. 8, it is contemplated that the retried ignition in block 220 may be ended prematurely if a low voltage level is detected in the burner assembly, similar to block 214. If desired, steps similar to decision blocks 202 and 212 may also be added to the retried ignition attempt.

Figure 9:
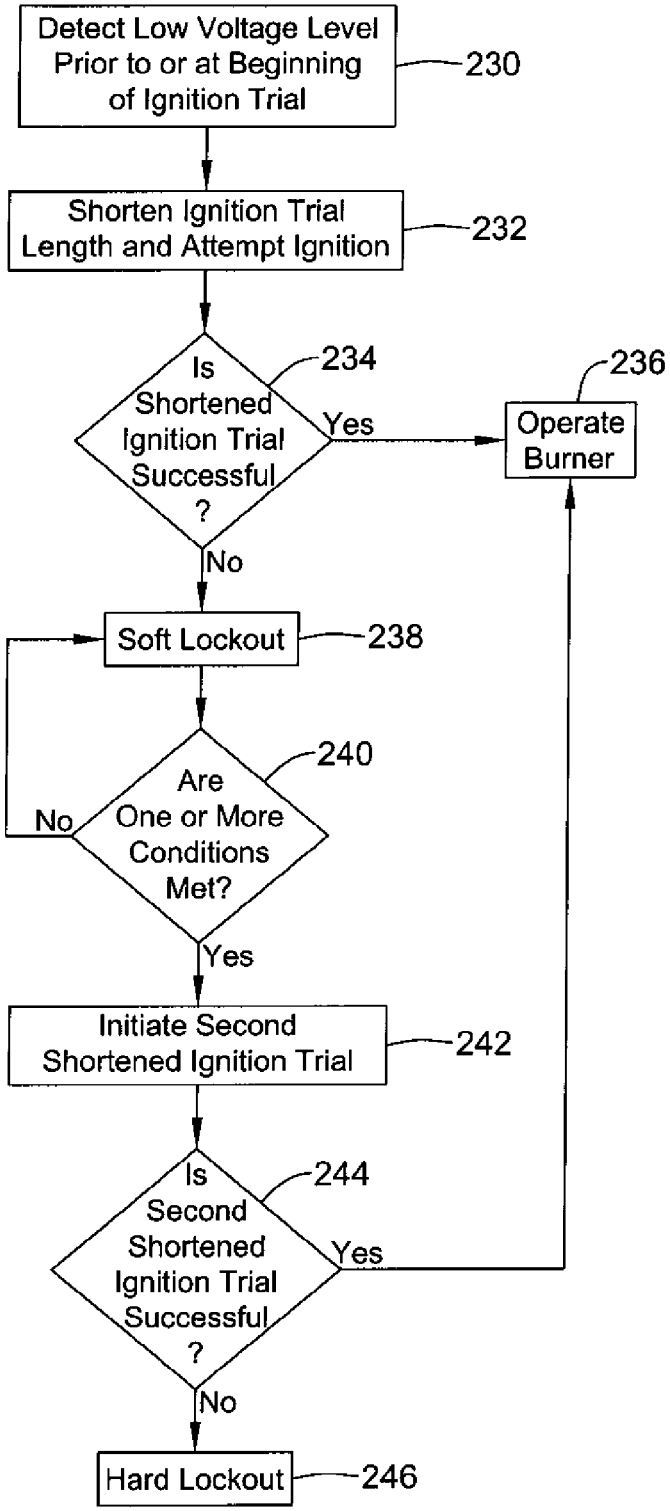

FIG. 9 is a flow diagram of another illustrative method of operating a fuel-fired controller. In some embodiments, the illustrative method may be employed by controller 48 shown in FIG. 4. As shown in block 230, the controller may detect a low voltage level in the burner assembly prior to or at the beginning of an ignition attempt. If a low voltage level is detected, in block 232, the controller may be configured to shorten the ignition trial length to a shortened trial length and perform the shortened ignition trial. In some embodiments, the shortened ignition trial length may be a length of time so that two or more shortened ignition trials can be performed without exceeding the first period of time. In some embodiments, under normal operating conditions, the controller can be programmed to perform an ignition trial for a first period of time, such as, for example, 15 seconds. In this example, the controller may be programmed to set the shortened ignition trial length for 7.5 seconds and perform two shortened ignition trials before entering the hard lockout state. In other cases, the controller may set the shortened ignition trial length to 5 seconds and perform three ignition trials before entering the hard lockout state. Also, it is contemplated that the shortened trial lengths may be different lengths, if desired. In this example embodiment where the total duration of the shortened ignition trials does not exceed the normal ignition trial length, the amount of fuel released into the burner assembly may not exceed the amount expected by the manufacturer.

In decision block 234, the controller may determine if the shortened ignition trial was successful. If the shortened ignition trial was successful, in block 236, the controller may operate the burner assembly under normal operating condition. If the shortened ignition trial was not successful, in block 238, the controller enters a soft lockout state.

In decision block 240, the controller may determine if one or more conditions have been met. Example conditions may be similar to those discussed above and may include the voltage level increasing to a "normal" voltage level range, a period of time has passed, or other conditions, as desired. If one or more of the conditions have not been met, the controller may stay in the soft lockout state in block 238. If one or more of the conditions have been met, then in block 242, the controller can initiate a second shortened ignition trial. Then, in decision block 244, the controller may determine if the second shortened ignition trial was successful. If the second shortened ignition trial was successful, then in block 236, the controller may operate the burner assembly. If the second shortened ignition trial was not successful, the controller may enter the hard lockout state in block 246. As shown in FIG. 9, the controller has two shortened ignition trial lengths that do not exceed the normal ignition trial length. However, as discussed above, it is contemplated that two, three, four, five, six, or any other number of shortened ignition trial lengths may be used. In some embodiments, the total length of all of the shortened ignition trials may be less than or equal to the normal ignition trial length, if desired. In the example embodiment of three of more shortened ignition trials, the controller may enter the soft lockout state between each of the shortened ignition trials, if desire.

Although not shown in the flow diagrams of FIGS. 5-9, the controller may also be configured to increase the LVD level and/or low voltage level based on the voltage level of the failed ignition trials, but this is not required.

Having thus described the preferred embodiments of the present invention, those of skill in the art will readily appreciate that yet other embodiments may be made and used within the scope of the claims hereto attached.

What is claimed is:

1. A controller for controlling the operation of a burner in a fuel-fired appliance, the controller comprising:

a control block that has a soft lockout state and a hard lockout state, wherein in the hard lockout state, the control block prevents ignition of the burner until the hard lockout is manually overridden by a user;

the control block is configured to enter the hard lockout state if the burner fails to ignite a fuel one or more times when a voltage level of a voltage supply of the burner is above a first predefined voltage threshold; and the control block is configured to enter the soft lockout state if the burner fails to ignite the fuel when the voltage level of the voltage supply of the burner is below a second predefined voltage threshold.

2. The controller of claim 1, wherein the first predefined voltage threshold is the same as the second predefined voltage threshold.

3. A controller for a fuel-fired appliance, the controller comprising:

a flame detection module for detecting a presence or absence of a flame in a burner assembly of the fuel-fired appliance;

a voltage detection module for detecting a voltage level of a voltage supply of the burner assembly; and a control block configured to receive:

a flame detection output signal from the flame detection module corresponding to the presence or absence of the flame in response to an ignition attempt of the burner assembly;

a voltage detection output signal from the voltage detection module corresponding to the voltage level of the voltage supply of the burner assembly;

wherein the control block is configured to selectively initiate a soft lockout if both: 1) the burner fails to ignite the fuel in response to the ignition attempt of the burner assembly; and 2) the voltage level of the voltage supply of the burner assembly is less than a first voltage level;

the control block is further configured to selectively initiate a hard lockout if both: 1) the burner fails to ignite the fuel in response to the ignition attempt of the burner assembly; and 2) the voltage level of the voltage supply of the burner assembly is greater than a second voltage level;

wherein when in a soft lockout, the control block is configured to subsequently initiate another ignition attempt of the burner assembly after one or more conditions are satisfied; and wherein when in the hard lockout, the control block prevents ignition of the burner assembly until the hard lockout is manually overridden by a user.

4. The controller of claim 3, wherein the first voltage level and the second voltage level are the same.

5. The controller of claim 3, wherein the first voltage level is less than the second voltage level.

6. The controller of claim 3, wherein:

the control block is configured to initiate the soft lockout if the voltage level of the voltage supply of the burner assembly is less than a low voltage level prior to or during a failed ignition attempt; and wherein the control block is programmed to initiate the hard lockout if the voltage level of the voltage supply of the burner assembly is greater than the low voltage level prior to or during the failed ignition attempt.

7. The controller of claim 3, wherein the control block is configured to end the ignition attempt prematurely and enter the soft lockout if the voltage level of the voltage supply of the burner assembly is less than the first voltage level and the flame detection module detects that the flame is absent.

8. The controller of claim 3, wherein the control block is configured to perform an ignition attempt lasting a first amount of time and, when the voltage level of the voltage supply of the burner assembly is detected as being less than the first voltage level, the control block is programmed to perform multiple shortened ignition attempts each having a duration of less than the first amount of time, wherein the control block is configured to enter the soft lockout between each of the multiple shortened ignition attempts if the burner assembly fails to ignite the fuel, and wherein the control block is programmed to enter the hard lockout if all of the multiple shortened ignition attempts fail to ignite the fuel.

9. The controller of claim 3, wherein the one or more conditions include detecting a voltage level of the voltage supply of the burner assembly that is greater than the second voltage level.

10. The controller of claim 3, wherein the one or more conditions include determining that a period of time has elapsed.

11. The controller of claim 3, wherein the one or more conditions include detecting a voltage level of the voltage supply of the burner assembly that is greater than the second voltage level and determining that a period of time has elapsed.

12. The controller of claim 3, wherein the control block is configured to enter the hard lockout if the subsequently initiated ignition attempt of the burner assembly fails to ignite the burner assembly.

13. The controller of claim 3, wherein the first voltage level is based, at least in part, on one or more prior successful and/or failed ignition attempts.

14. The controller of claim 3, wherein the burner assembly includes an electric pump that delivers fuel under pressure to a nozzle, and wherein the capacity of the electric pump is dependent upon the voltage level of the voltage supply of the burner assembly.

15. A controller for a fuel-fired appliance, the controller comprising:

a flame detection module for detecting a presence or absence of a flame in a burner assembly of the fuel-fired appliance;

a voltage detection module for detecting a voltage level of a voltage supply of the burner assembly of the fuel-fired appliance;

a control block configured to receive a flame detection output signal from the flame detection module corresponding to the presence or absence of the flame and a voltage detection output signal from the voltage detection module corresponding to the voltage level of the voltage supply of the burner assembly, wherein the control block is programmed to selectively initiate a soft lockout if both: 1) the burner fails to ignite the fuel; and 2) the voltage level of the voltage supply of the burner assembly is less than a low voltage level, and the control block is programmed to selectively initiate a hard lockout if both: 1) the burner fails to ignite the fuel; and 2) the voltage level of the voltage supply of the burner assembly is greater than the low voltage level;

wherein when in a soft lockout, the control block is configured to subsequently attempt ignition after one or more conditions are detected; and wherein when in the hard lockout, the control block prevents ignition of the burner assembly until the hard lockout is manually overridden by a user.

16. The controller of claim 15, wherein the control block is programmed to initiate the soft lockout if the voltage level of voltage supply of the burner assembly is less than the low voltage level prior to or during a failed ignition attempt, and wherein the control block is programmed to initiate a hard lockout if the voltage level of voltage supply of the burner assembly is greater than the low voltage level prior to or during the failed ignition attempt.

17. The controller of claim 15, wherein the control block is programmed to end the ignition attempt prematurely and enter the soft lockout state if the voltage level of voltage supply of the burner assembly is less than the low voltage level and the flame detection module detects that the flame is absent.

18. The controller of claim 15, wherein the control block is programmed to perform ignition attempts lasting a first amount of time and, when the voltage level of voltage supply of the burner assembly is detected as being less than the low voltage level, the control block is programmed to perform multiple shortened ignition attempts together lasting at most the first amount of time, wherein the control block is programmed to enter the soft lockout state between each of the multiple shortened ignition attempts if the burner assembly fails to ignite the fuel, and the control block is programmed to enter the hard lockout state after ignition has been attempted for the first length of time if the burner assembly has failed to ignite the fuel.

19. The controller of claim 15, wherein the one or more conditions includes one or more of:

detecting a voltage level that is greater than the low voltage level; and determining that a period of time has elapsed.

20. The controller of claim 15, wherein the low voltage level is based, at least in part, on successful and/or failed ignition attempts.

* * * * *